United States Patent [19]

Burger et al.

[11] 4,220,021

[45] Sep. 2, 1980

[54] CONTROL DEVICE FOR USE IN A LOCK

[75] Inventors: Alfred Burger; Adalbert Paar, both of Vienna, Austria

[73] Assignee: EVVA-Werk Spezialerzeugung von Zylinder- und Sicherheitsschloessern Gesellschaft m.b.H. Kommanditgesellschaft, Vienna, Austria

[21] Appl. No.: 16,893

[22] Filed: Mar. 2, 1979

[30] Foreign Application Priority Data

| | | | |
|---|---|---|---|
| Mar. 6, 1978 | [AT] | Austria | 1574/78 |
| Jun. 29, 1978 | [AT] | Austria | 4750/78 |
| Jan. 5, 1979 | [AT] | Austria | 97/79 |

[51] Int. Cl.[2] ..... E05B 9/10; E05B 17/04; E05B 29/00; E05B 47/00

[52] U.S. Cl. ..... 70/276; 70/365; 70/373; 70/375; 70/380

[58] Field of Search ..... 70/358, 364 A, 366, 70/276, 379 A, 380, DIG. 60, 373, 375, 365

[56] References Cited

U.S. PATENT DOCUMENTS 4,084,416 4/1978 Prunbeuer ..... 70/276

FOREIGN PATENT DOCUMENTS 2349760 4/1975 Fed. Rep. of Germany ..... 70/276
1093123 11/1954 France ..... 70/380

*Primary Examiner*—Robert L. Wolfe
*Attorney, Agent, or Firm*—Michael J. Striker

[57] ABSTRACT

The control device for cylindrical locks includes a housing having on its inner surface longitudinal and annular guiding recesses, a cylindrical plug or core rotatable in the housing about its center axis and defining on its surface second recesses, at least one magnetic rotor supported in the plug for rotation about an axis transverse to the center axis and defining a third recess alignable with the second recess, control strap arranged for axial displacement on the plug and being rotatable therewith, and arresting elements projecting from the strap into the first and second recesses and being axially displaceable with the strap into engagement with the third recess in the rotary member when this third recess is in alignment with the second recess.

12 Claims, 10 Drawing Figures

CONTROL DEVICE FOR USE IN A LOCK

BACKGROUND OF THE INVENTION

This invention relates generally to control devices for locks and more particularly it relates to a control device of the type having a tubular housing, a cylindrical core or plug rotatable in the housing about its center axis, and at least one magnetic rotor supported in the plug for rotation about an axis transverse to the center axis.

The disadvantage of prior-art control devices of this type is the fact that upon insertion of a wrong key and exerting an excessive force against the key, the magnetic rotary members which prevent the rotation of the plug are susceptible to damage.

SUMMARY OF THE INVENTION

The object of the present invention is to overcome the aforementioned disadvantage.

More particularly, it is an object of the invention to provide an improved control device for cylindrical locks which is resistant against excessive forces applied against the key.

A further object of the invention is to provide such a control device which is applicable for different kinds of cylindrical locks, such as for a single cylinder lock or for a double cylinder lock, for example.

In keeping with these objects, and with others which will become apparent hereafter, one feature of the invention resides in a control device of the aforedescribed type, in the provision of first guiding recesses in the inner wall of the housing, a second recess in the upper surface of the plug, a third recess in the surface portion of the magnetic rotor which communicates with the second recess, a control strap arranged for axial movement on the plug and being rotatable therewith, and arresting elements projecting from the strap into the first and second recesses and being axially displaceable with the strap into engagement with the third recess when the latter is in alignment with the second recess.

According to another feature of this invention, the control strap is provided at its end with run-up surfaces inclined to the path of movement of the strap to act against corresponding inclined surfaces of a stop ring. The stop ring is rotatably arranged in the housing and is releasably held in a fixed position by means of a spring-biased ball-and-socket catch.

The arresting elements are in the form of pins projecting inwardly into the grooves in the plug and during the axial displacement of the control strap they engage the recess in the magnetic rotor so that in accordance with the angular position of the rotor they permit the axial movement of the strap or arrest the same.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS:

The control device of this invention as illustrated in FIGS. 1–7 is shown in connection with a single cylindrical plug of a lock system, the locking part 32 of which (FIGS. 1–3) performs the locking function. The door equipped with this lock system can be operated either from one side only (for example in the case of a post-office box) or can be operated also from the other side by means of a handle, rotary knob and the like.

Figure 1:
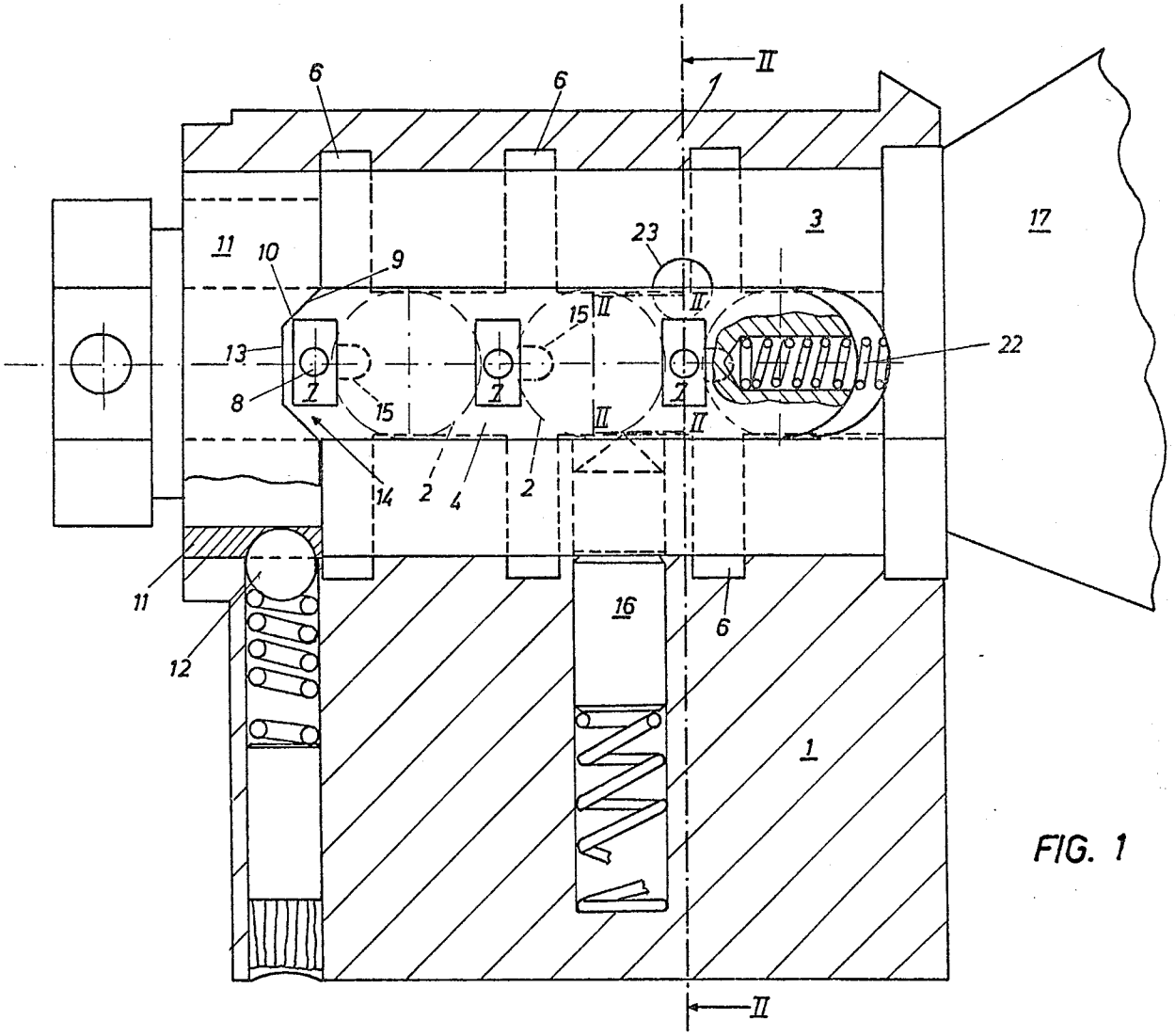
FIG. 1 is a sectional side view of one embodiment of the control device of this invention taken along the line I—I of FIG. 2.
Figure 2:
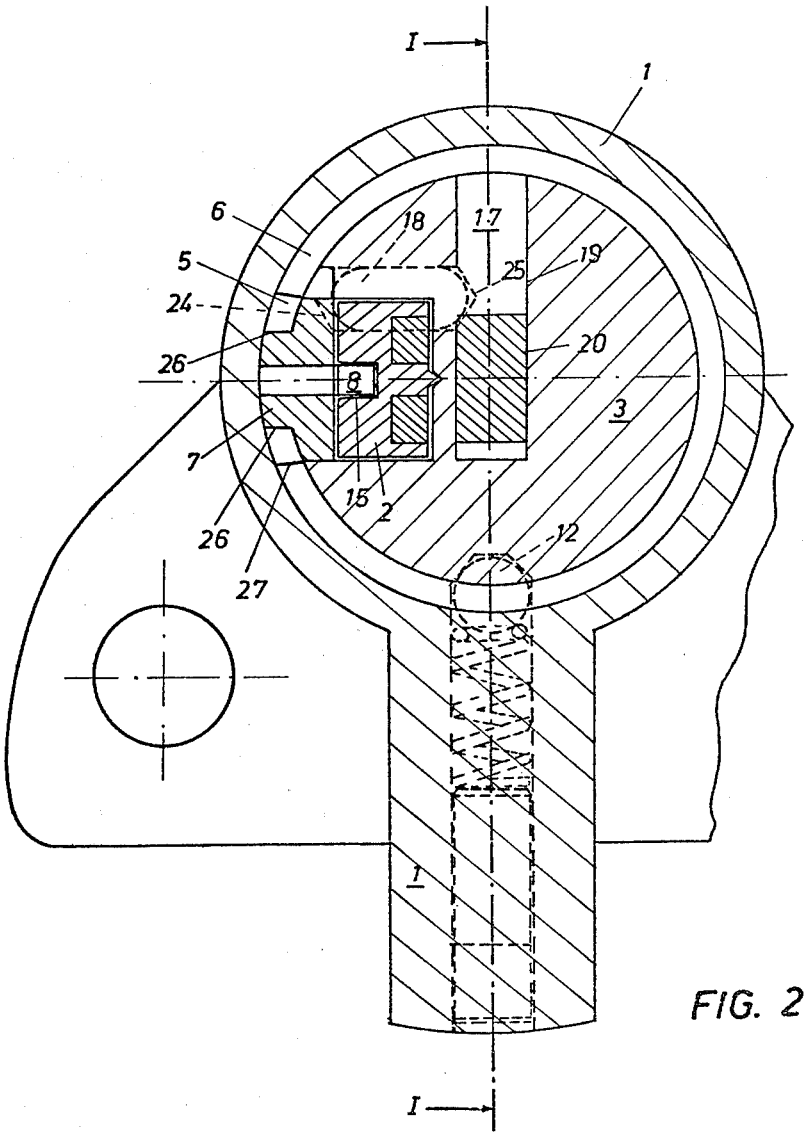
FIG. 2 is a sectional rear view of the device taken along the line II—II in FIG. 1.
Figure 3:
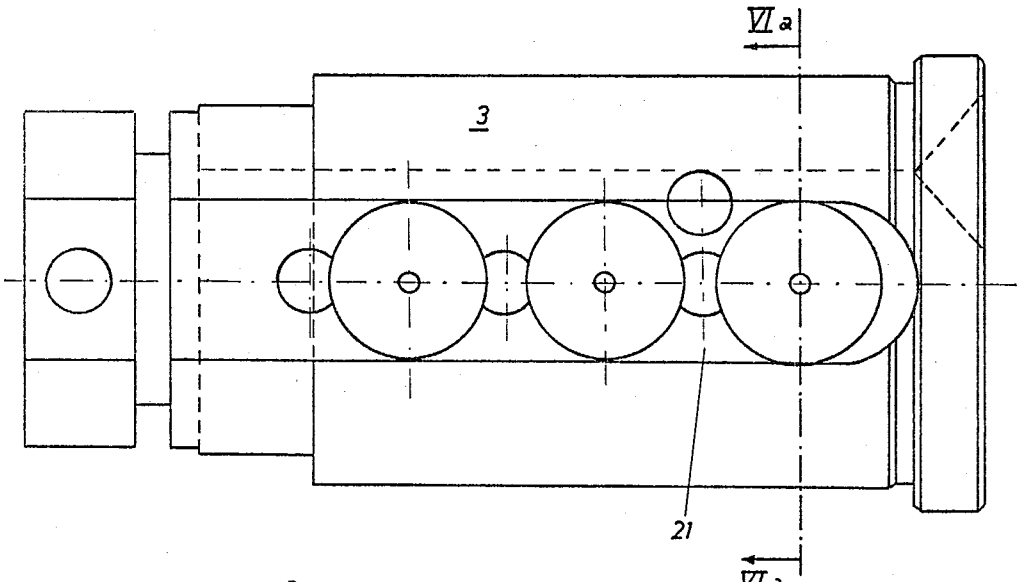
FIG. 3 is a side view of the cylindrical plug of FIG. 1.
Figure 4:
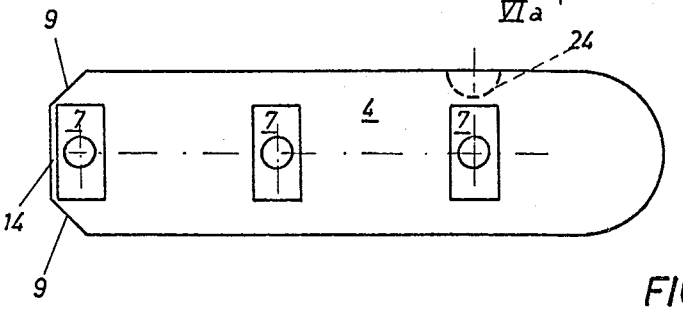
FIG. 4 is a side view of the control strap in the device of this invention.
Figure 5:
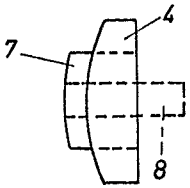
FIG. 5 is a rear view of the strap of FIG. 4.
Figure 6:
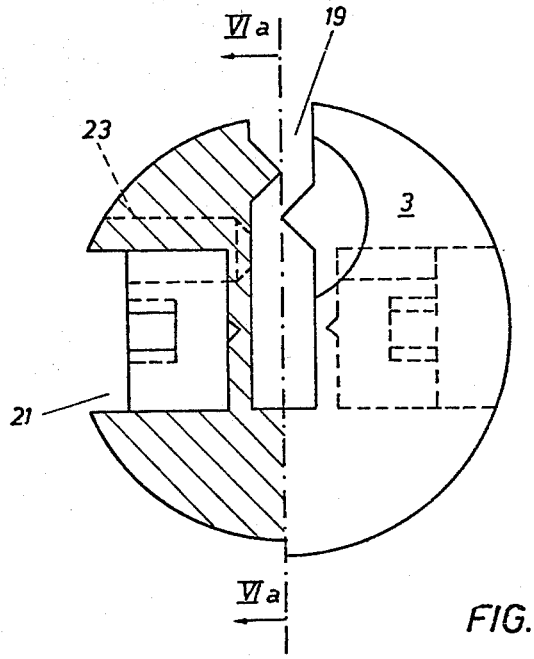
FIG. 6 is a rear view of the plug of FIG. 3 partly taken in section along the line VI—VI.

Referring now to FIGS. 1 and 2, a cylindrical core or plug 3 is rotatably supported in a housing 1 of the control device of this invention. Plug 3 has a key channel 19 in which a key 17 having three key magnets 20 is insertable. As illustrated in FIG. 3, the upper surface of plug 3 is provided with a longitudinal recess or groove 21 extending parallel to the key channel 19 and communicating with transverse blind borings 33 in which magnetic rotary members or rotors 2 are rotatably supported and are adjustable in a known manner by key magnets 20 into a predetermined angular position. In the axial groove 21, there is supported a control strap 4 which is slidable in axial direction over the magnetic rotors 2 and is urged by a biasing spring 22 to the rear end of the housing, that means to the left in FIG. 1.

The control strap 4 firmly supports arresting members including outer arresting elements 7 and inner arresting pins 8 projecting inwardly into a recess in plug 3. The rear (left-hand) end of control strap 4 forms a trapezoidal extension 14 defining two lateral shoulders 9 extending obliquely to the path of travel of the strap 4. The trapezoidal extension 14 in the position of strap 4 as illustrated in FIG. 1 engages a correspondingly shaped recess 13 in a stop ring 11. The sloping shoulders 10 of the recess 13 thus abut against the sloping shoulders 9 of the extension 14. The stop ring 11 surrounds within the housing 1 the rear end portion of plug 3 and is freely rotatable relative both to the housing and to the plug. The angular position of the stop ring relative to housing 1 is releasably fixed by means of a spring-biased socket-and-ball catch 12.

Figure 7:
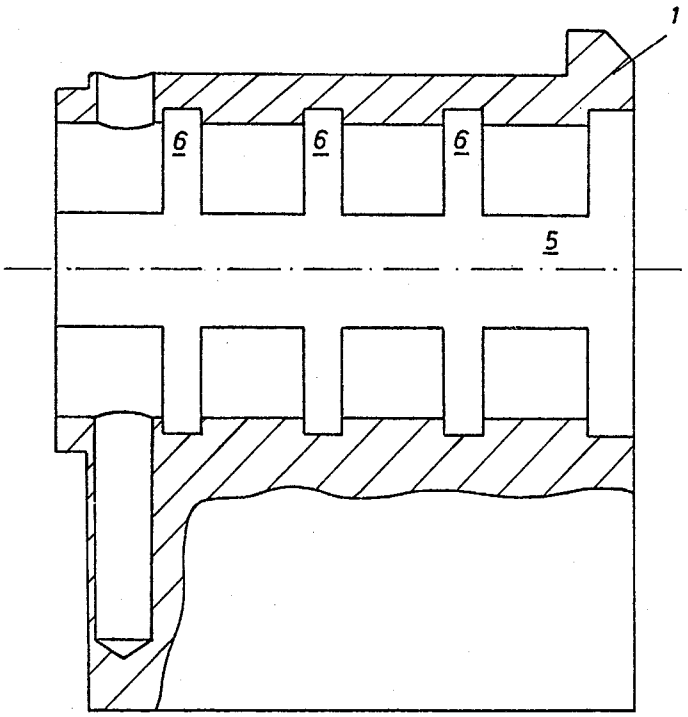
FIG. 7 is a sectional side view of the housing of the device of this invention.

The inner wall of housing 1, as shown in FIG. 7, is provided with an axially directed longitudinal groove 5 and annular groove 6 communicating with the groove 5. Both the longitudinal groove 5 and the annular groove 6 are dimensioned such that the outer arresting elements 7 are guided in axial direction in the groove 5 and, at predetermined axial positions of the strap, are guided in annular groove 6 to rotate together with the plug 3.

Plug 3 is further provided with a boring 23 extending parallel to the axis of rotation of magnetic rotors 2 to accommodate a key retaining pin 18. In the position of strap 4 as illustrated in FIG. 1, the end of the key retaining pin 18 remote from the key engages a conical recess 24 in the control strap so that key 17 inserted into the key channel displaces the end portion of key retaining pin 18 out of the key channel and the other end of the pin engages the recess 24.

The operation of the control device of this invention is as follows:

If a key 17 with correctly coded key magnets 20 is inserted into key channel 19, magnetic rotors 2 are turned into their operative angular position shown in FIG. 1, that means the recesses 15 of all rotors are positioned opposite to the arresting bolts 8 of the blocking strap.

By turning key 17 together with plug 3 and strap 4, the sloping shoulders 9 of extension 14 of the strap run up the recessed shoulders 10 of stop ring 11 and strap 4 is axially displaced to the right against the pressure of spring 22. During this axial movement the arresting bolts 8 engage the recesses 15 of magnetic rotors 2. At the same time, due to this axial displacement, the key retaining pin 18 is disengaged from the conical recess 24 and is shifted toward the key channel 19 to engage its projecting end portion with corresponding recess 25 in the key so that the position of the key in the channel is fixed. Due to the axial displacement of strap 4, the outer arresting elements 7 are brought in the range of annular grooves 6 in the inner wall of the housing and plug 3 can be further rotated to complete the locking process.

Upon the completion of the locking process, that means upon the rotation of the plug about 360°, spring 22 returns strap 4 into its initial position in which trapezoidal extension 14 engages the recess 13 of stop ring 11 and the key retaining pin 18 is free to move into the conical recess 24 so that key 17 could be removed from the key channel.

If a wrong key is inserted into the conical device of this invention, that means if the key magnets are arranged according to a wrong code and/or if the key notch or recess 25 is cut out at a wrong place, at least one groove 15 of rotor 2 is misaligned with the assigned arresting bolt 8. Consequently, if a rotary moment is applied to the plug 3, the strap 4 cannot be axially displaced to the right. The rotary moment from key 17 is transmitted via extension 14 to the stop ring 11 which upon the application of a rotary force that exceeds the holding force of the spring-biased catch 12, is jointly rotated with plug 3. After a slight angular displacement of the plug, the lateral edge 26 of outer arresting elements 7 abuts against the edge 27 of the longitudinal groove 5 in the housing and consequently any further rotation of the plug is prevented and thus the actuation of the device by a wrong key is also prevented.

In the above-described example, the control structure according to this invention is shown for the sake of clarity on one-half of the plug only. It is, however, of advantage when the arresting structure is arranged on both sides of the key channel so that the number of possible arresting variations or combinations as well as the strength of the arresting mechanism is increased. In such a symmetrical construction, however, the stop ring 11 has to be provided with two diametrically opposed recesses 13.

Figure 8:
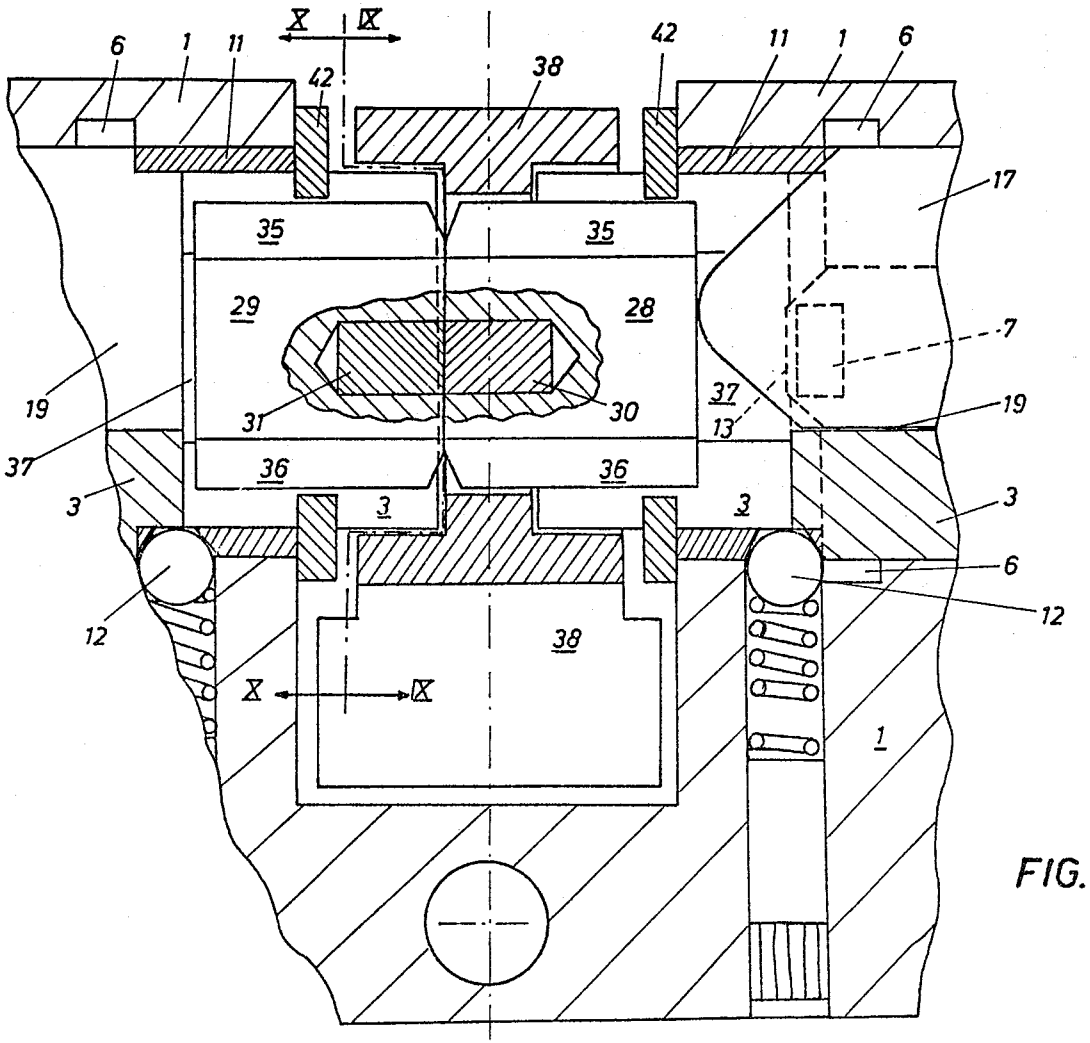
FIG. 8 shows in a sectional side view a cut-away portion of another embodiment of the device of this invention.

The control device of this invention can also be used in connection with a double cylinder lock in which the control mechanism is arranged both in the outer plug segment and in the inner plug segment. FIG. 8 illustrates coupling means between the inner and outer plug segment of the double cylinder lock.

The coupling means in the device of this invention includes two coupling parts 28 and 29 each having a cylindrical body 34 provided with two wings 35 and 36. Rod magnets 30 and 35 are secured in cylindrical body 34 of respective coupling parts 28 and 29 and are magnetized in opposite sense so that both coupling parts magnetically attract each other. Both coupling parts are supported for axial displacement in correspondingly shaped slots 37 in the plug segments. An arresting ring 38 has a central plate 39 provided with crossing slots 40 which are engageable from the left or from the right with the coupling parts 28 and 29.

Figure 9:
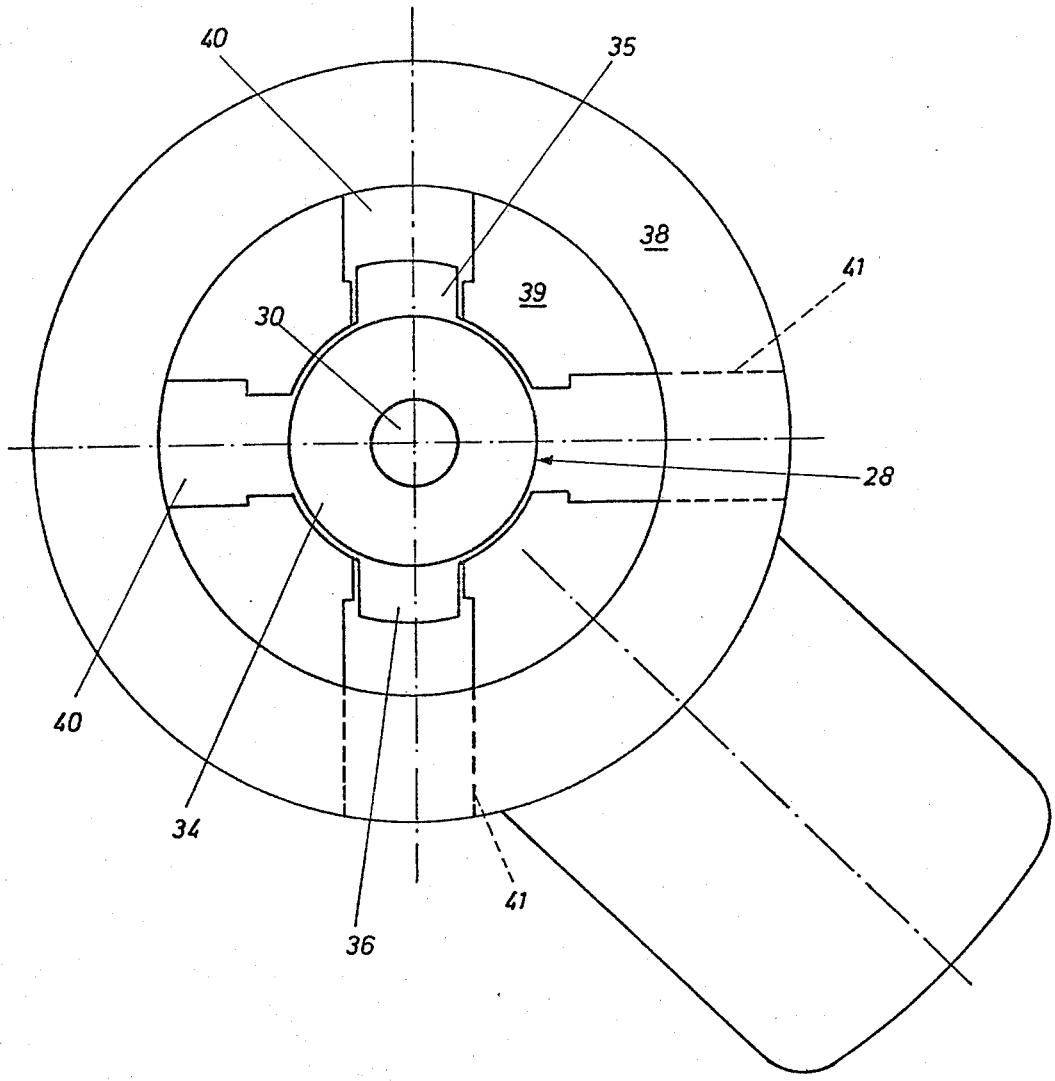
FIG. 9 is a sectional front view of the coupling means of FIG. 8 taken along the line IX—IX.
Figure 10:
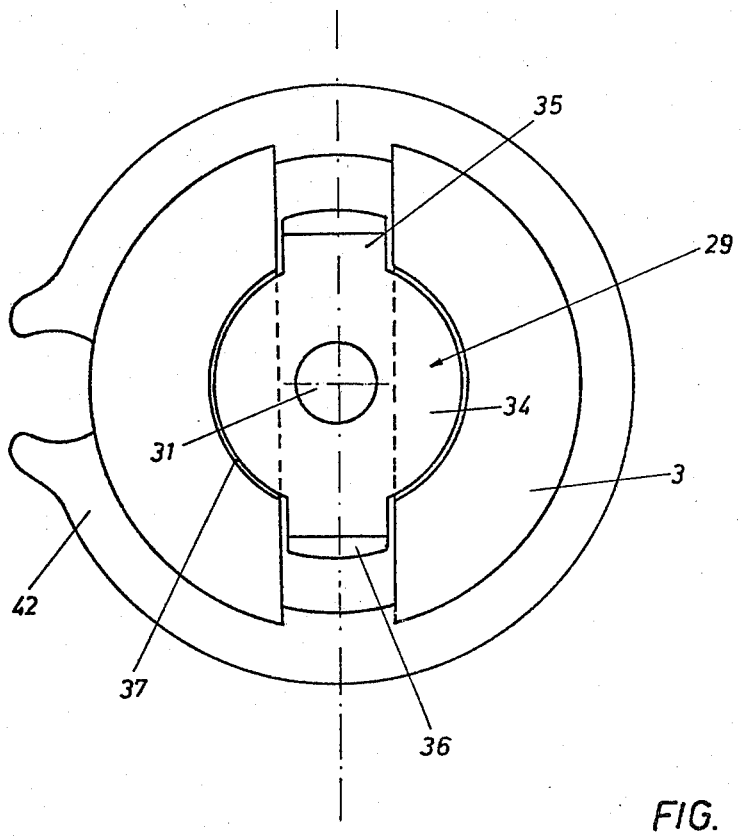
FIG. 10 is a sectional rear view of the coupling means of FIG. 8 taken along the line X—X.

After key 17 has been completely inserted into the key channel (from the right-hand side in FIG. 8), both coupling parts are shifted in axial direction in such a manner that coupling part 28 adjoining the key is coupled to the other part between plug segment 3 and arresting ring 38 whereby the other coupling part 29 is shifted out of the range of the arresting ring. As a result of this displacement, the right-hand plug segment 28 can be rotated by means of key 30 and rotates therewith the arresting ring 38 without rotating the left-hand plug segment 29. As seen from FIG. 9, the crossing slits 40 communicate with borings 41 passing through the annular part of arresting ring 38. By means of non-illustrated pins arranged in borings 41 it is possible to separate both coupling parts one from the other whereby the arresting ring is angularly displaced relative to both plug segments and to the coupling parts and the lock can be easily adjusted from a counterclockwise operation to a clockwise operation. Reference numeral 42 in FIGS. 8 and 10 indicates resilient rings for holding the plug segments in housing 1.

The coupling in the device of this invention is very simple in structure and does not require any spring elements for exact guiding of its coupling parts. Inasmuch as such spring elements are not used, the coupling means can be inserted between the plug segments after the assembly of a double cylinder lock.

In a special case it can also be advantageous when one or both coupling parts as a whole are made of magnetic material such as, for example, Al-Ni-CO. It is of course also possible to use a rod magnet in one coupling part only whereas the opposite coupling part is made of a magnetizable material which is attracted by the rod magnet 30 or 31.

The control device of this invention can be with particular advantage employed in combination with tumbler pins of conventional design. In FIG. 1 there is illustrated schematically one tumbler pin 16. By using the tumbler pins the number of variations or combinations of the lock code can substantially be increased.

The control device of this invention is simple in structure and inexpensive to manufacture since it can be assembled of component parts made by pressure casting or sintering. The parts are dimensioned such that a compact structure of the lock will result and thus a high strength of the lock is attained. For example, in comparison with controlling devices which use an arresting sleeve movable between the plug and the housing, the walls of the housing in the device of this invention can be made more bulky so that the lock is not weakened.

Also in the device of this invention the plug retains a standard diameter of 13 millimeters. The magnetic coupling means described in connection with this invention can also find an application in combination with other types of locking devices.

While the invention has been illustrated and described as embodied in a control device for the locks, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A control device, particularly for use in connection with a lock, comprising a housing having on its inner surface a first guiding recess; a cylindrical plug rotatable in said housing about its center axis and defining on its surface a second recess; at least one magnetic rotor supported in said plug for rotation about an axis transverse to said center axis and defining a third recess alignable with said second recess; a control strap arranged for axial movement on said plug and being rotatable therewith; and arresting elements projecting from said strap into said first and second recesses and being axially displaceable with said strap into engagement with said third recess when the latter is in alignment with said second recess.

2. The device as defined in claim 1, further including a stop ring rotatably supported in said housing opposite one face of said plug, the end of said strap facing said stop ring having run-up surfaces inclined relative to the path of movement of said strap and said stop ring having corresponding recessed surfaces for engaging said run-up surfaces.

3. The device as defined in claim 2, further including a spring-biased ball-catch engaging said stop ring to releasably hold the latter in a fixed position relative to said housing.

4. The device as defined in claim 3, wherein said recessed surfaces in said stop ring are lateral edges of an axial recess, said lateral edges being inclined to the path of movement of said strap to slidably displace said strap in axial direction out of engagement with said stop ring when said plug is being rotated.

5. The device as defined in claim 1, wherein said arresting elements include inwardly projecting bolts engaging the second recesses in said plug and cooperating with said magnetic rotary members to engage during the axial displacement of said strap said third recesses when the latter are aligned by the insertion of a correct key and alternatively to abut against the cylindrical wall of said magnetic members when said third recesses are misaligned.

6. The device as defined in claim 5, wherein said first recess in said housing includes longitudinal grooves and annular grooves, said arresting elements further including outer projections guided in said longitudinal grooves, said annular grooves communicating with said longitudinal grooves at points corresponding to the position of said outer arresting projections during the axial disengagement of said strap from said stop ring.

7. The device as defined in claim 6, wherein said outer arresting projections and said inner arresting bolts are in alignment with each other.

8. The device as defined in claim 1, further including tumbler pins arranged for radial movement between said housing and said plug.

9. The device as defined in claim 1, further including a key retaining pin arranged for movement in said plug parallel to the axis of rotation of said magnetic rotary members and being displaceable by a key introduced into said plug to engage a recess in said strap and alternatively to enter an opposite recess in said key, thus retaining the key in a fixed position in said plug.

10. The device as defined in claim 1, for use in a double cylinder lock, comprising two plug segments arranged in series, an arresting ring rotatable in said housing between said plug segments, and coupling means having two coupling parts connected to said segments and magnetically attracted to one another in the range of said arresting ring.

11. The device as defined in claim 10, wherein at least one coupling part is made of an Al-Ni-CO magnetic material.

12. The device as defined in claim 10, wherein said coupling parts include rod magnets arranged in axial borings in respective parts.

* * * * *